US011097345B2

(12) United States Patent
Fribourg

(10) Patent No.: US 11,097,345 B2
(45) Date of Patent: Aug. 24, 2021

(54) METHOD FOR PRODUCING A PART CONSISTING OF A COMPOSITE MATERIAL

(71) Applicant: SAFRAN AIRCRAFT ENGINES, Paris (FR)

(72) Inventor: Guillaume Fribourg, Grenoble (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 262 days.

(21) Appl. No.: 15/750,008

(22) PCT Filed: Aug. 2, 2016

(86) PCT No.: PCT/FR2016/052012
§ 371 (c)(1),
(2) Date: Feb. 2, 2018

(87) PCT Pub. No.: WO2017/021652
PCT Pub. Date: Feb. 9, 2017

(65) Prior Publication Data

US 2018/0221957 A1 Aug. 9, 2018

(30) Foreign Application Priority Data

Aug. 6, 2015 (FR) ..... 1557580

(51) Int. Cl.
*B22F 7/06* (2006.01)
*C22C 47/02* (2006.01)
(Continued)

(52) U.S. Cl.
CPC ..... *B22F 7/062* (2013.01); *C22C 47/025* (2013.01); *C22C 47/04* (2013.01); *C22C 47/14* (2013.01);
(Continued)

(58) Field of Classification Search
CPC ..... B22F 3/1021; B22F 3/1025; B22F 3/225; B22F 7/02; B22F 7/062; B22F 7/064;
(Continued)

(56) References Cited

U.S. PATENT DOCUMENTS 4,885,214 A * 12/1989 Trenkler ..... B22F 1/0003 428/614
6,299,810 B1 * 10/2001 Blackinton, Jr. ..... B29C 53/66 264/102
(Continued)

FOREIGN PATENT DOCUMENTS

EP 0 334 505 A1 9/1989
EP 0 360 468 A1 3/1990
(Continued)

OTHER PUBLICATIONS

Metal Injection Molding, 2010. Industrialmetalcastings.com, <<http://www.industrialmetalcastings.com/casting_metal_injection_mold.html>> (Year: 2010).*
(Continued)

*Primary Examiner* — Keith Walker
*Assistant Examiner* — Benjamin C Anderson
(74) *Attorney, Agent, or Firm* — Pillsbury Winthrop Shaw Pittman LLP

(57) ABSTRACT

A method includes fabricating a part out of composite material including fiber reinforcement densified by a metal matrix.

20 Claims, 6 Drawing Sheets

(51) Int. Cl.

| | |
|---|---|
| ***C22C 47/04*** | (2006.01) |
| ***C22C 47/14*** | (2006.01) |
| ***C22C 49/11*** | (2006.01) |
| ***C22C 49/14*** | (2006.01) |
| ***C22C 49/06*** | (2006.01) |
| ***C22C 49/08*** | (2006.01) |
| *B22F 3/10* | (2006.01) |
| *B22F 3/22* | (2006.01) |

(52) U.S. Cl.
CPC ..... *C22C 49/06* (2013.01); *C22C 49/08* (2013.01); *C22C 49/11* (2013.01); *C22C 49/14* (2013.01); *B22F 3/1021* (2013.01); *B22F 3/225* (2013.01); *B22F 2301/205* (2013.01); *B22F 2998/10* (2013.01)

(58) Field of Classification Search
CPC ..... C22C 47/025; C22C 47/04; C22C 47/14; C22C 49/06; C22C 49/08; C22C 49/11; C22C 49/14; C22C 47/02; C04B 20/0048–0072; C04B 30/02; C04B 35/74–83; C04B 41/4584; C04B 41/4596; C04B 2111/0037–00379; C04B 2235/5208–5272; C04B 2237/38–385
USPC ..... 228/120, 135, 138, 139, 140, 212, 213
See application file for complete search history.

(56) References Cited

U.S. PATENT DOCUMENTS

| | | | | |
|---|---|---|---|---|
| 6,698,645 | B1 * | 3/2004 | Buchberger | B22F 5/04 228/121 |
| 2003/0017053 | A1 * | 1/2003 | Baldwin | B29C 70/24 416/229 A |
| 2006/0263577 | A1 * | 11/2006 | Vetters | C22C 47/20 428/156 |
| 2008/0199343 | A1 * | 8/2008 | Rust | A61F 2/34 419/6 |
| 2011/0005061 | A1 * | 1/2011 | Masson | C22C 47/00 29/592 |
| 2011/0027119 | A1 | 2/2011 | Masson | |
| 2011/0171487 | A1 * | 7/2011 | Ruckert | C22C 47/20 428/615 |
| 2012/0037602 | A1 * | 2/2012 | Doorbar | C22C 47/04 219/121.14 |
| 2014/0272274 | A1 * | 9/2014 | Lazur | F01D 5/282 428/115 |
| 2017/0216911 | A1 * | 8/2017 | Sabah | B22D 18/06 |
| 2019/0168420 | A1 * | 6/2019 | Reese | C04B 35/80 |
| 2020/0123069 | A1 * | 4/2020 | Shim | C04B 37/023 |

FOREIGN PATENT DOCUMENTS

| | | | | |
|---|---|---|---|---|
| EP | 2 418 297 | A2 | 2/2012 | |
| FR | 2 886 180 | A1 | 12/2006 | |
| JP | 2001-011593 | A | 1/2001 | |
| WO | WO-2015056513 | A1 * | 4/2015 | B22F 7/064 |

OTHER PUBLICATIONS

"Metal Injection Molding", 2009. CustomPartNet. (Year: 2009).*
International Search Report as issued in International Patent Application No. PCT/FR2016/052012, dated Oct. 7, 2016.

* cited by examiner

FIG.6A
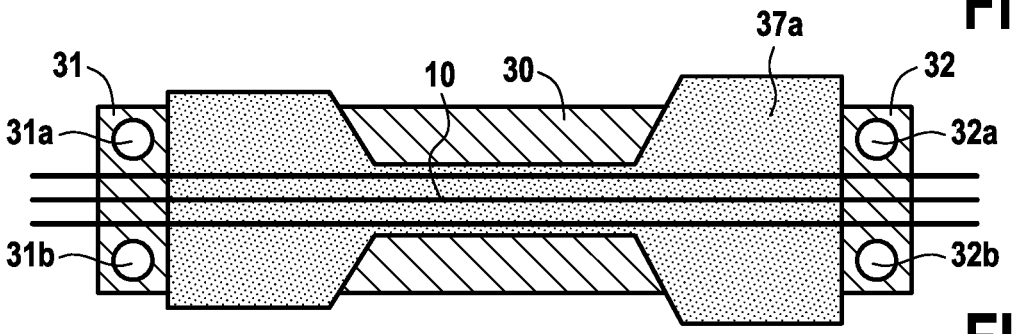
FIG.6B
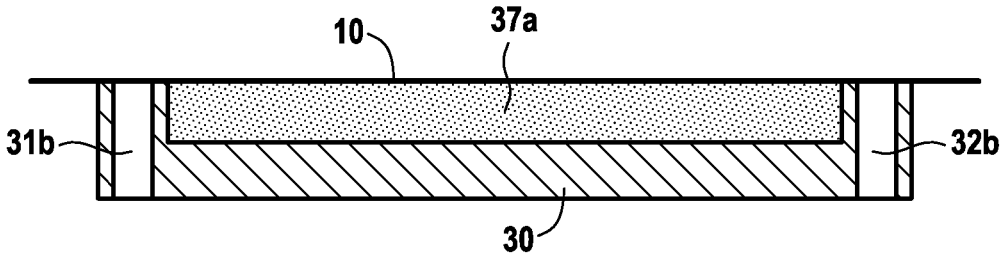
FIG.6C
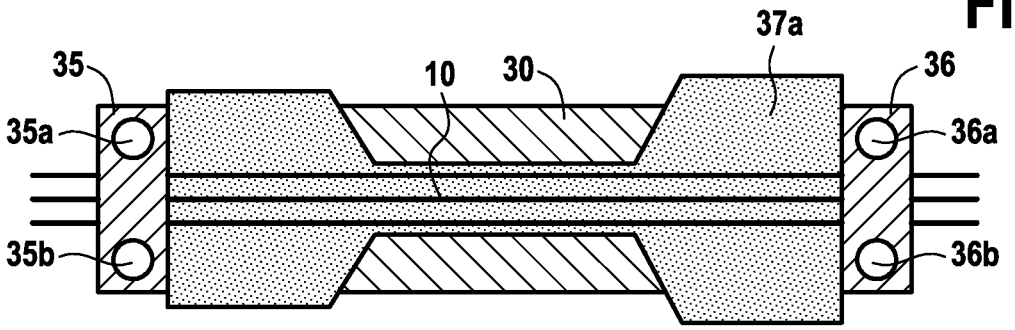
FIG.6D
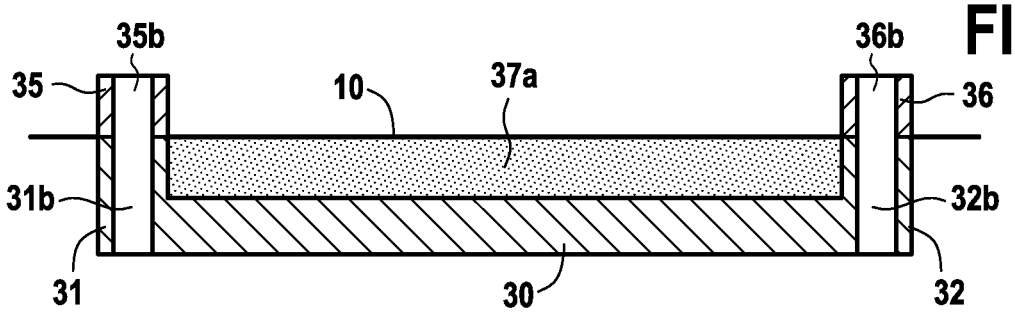
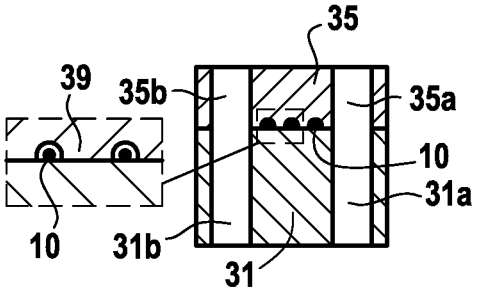
FIG.6E

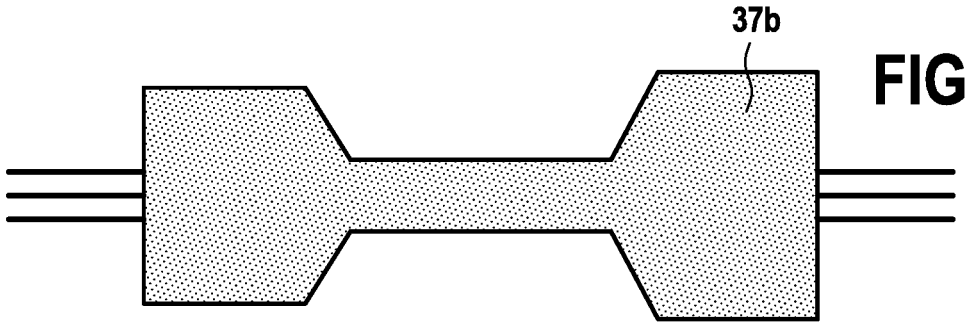
FIG.6J
FIG.6K
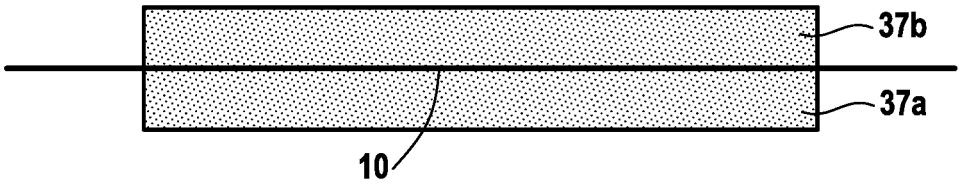
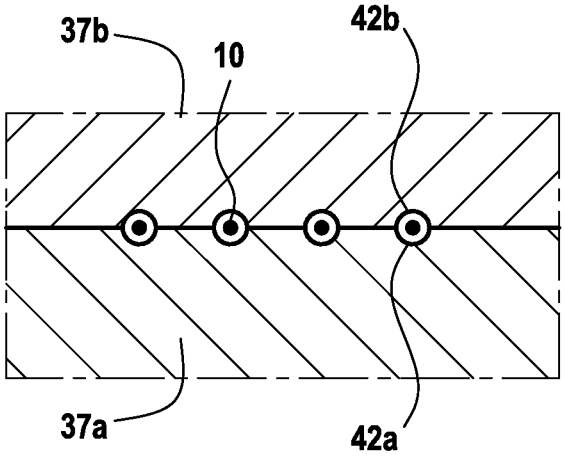
FIG.7

METHOD FOR PRODUCING A PART CONSISTING OF A COMPOSITE MATERIAL

CROSS REFERENCE TO RELATED APPLICATIONS

This application is the U.S. National Stage of PCT/FR2016/052012 filed Aug. 2, 2016, which in turn claims priority to French Application No. 1557580 filed Aug. 6, 2015. The contents of both applications are incorporated herein by reference in their entirety.

BACKGROUND OF THE INVENTION

The invention relates to a method of fabricating a composite part having a metal matrix.

It has been envisaged to reinforce metal parts by means of long fibers based on a ceramic material such as silicon carbide in order to give such parts improved mechanical properties (elastic limit, Young's modulus). Nevertheless, integrating long fibers in a metal matrix using conventional shaping methods (casting, forging, machining) is complex. In addition, the cohesion between the fibers and the metal matrix is generally weak, either because of poor diffusion between these two elements, or else because of a reaction between the fibers and the matrix.

One solution for improving cohesion between fibers and the metal matrix consists in using fibers constituted by a core of ceramic material and a sheath of metal material surrounding the core. By way of example, the sheath may be deposited by high-speed coating. Heat treatment by diffusion welding can then be performed in order to secure the fibers to a part that has previously been shaped, e.g. by being forged and/or machined. By way of example, such a solution is described in Document FR 2 886 180. That solution works, but it requires a long succession of operations: shaping the initial part, machining grooves for receiving the fibers, welding on a cap to close the part, and diffusion welding heat treatment. In addition, in that type of solution, the distribution of fibers requires specific operations on each occasion, making it relatively lengthy to distribute fibers in multiple positions. Also known is Document US 2011/0027119, which discloses a method of fabricating parts with a metal matrix composite material insert. Document EP 2 418 297 discloses a method of fabricating an article out of metal matrix composite material.

There therefore exists a need to have simpler methods for preparing metal matrix composite parts reinforced by ceramic fibers, while conserving satisfactory mechanical properties for the resulting parts.

OBJECT AND SUMMARY OF THE INVENTION

To this end, in a first aspect, the invention proposes a method of fabricating a part out of composite material comprising fiber reinforcement densified by a metal matrix, the method comprising at least the following steps:

a) positioning a plurality of fibers comprising a core, each made of ceramic material coated by a metal sheath on a first preform for a first portion of the part to be fabricated, said first preform comprising at least a metal powder of a first alloy and a first binder;

b) positioning a second preform for a second portion of the part to be fabricated on the first preform in order to obtain a stack structure, the fibers being present between the first preform and the second preform in said stack structure, said second preform comprising at least a metal powder of a second alloy and a second binder, the melting temperature $T_1$ of the first alloy, the melting temperature $T_2$ of the second alloy, and the melting temperature $T_3$ of the metal sheaths of the fibers satisfying the following two conditions:

$$|T_3-T_1|/T_1 \leq 25\%, \text{ and}$$

$$|T_3-T_2|/T_2 \leq 25\%,$$

c) eliminating the first and second binders present in the stack structure obtained after performing step b) in order to obtain a debindered stack structure; and d) heat treating the debindered stack structure in order to obtain the composite material part during which the metal sheaths of the fibers are assembled with the powders of the first and second alloys by diffusion welding and during which the powders of the first and second alloys are sintered in order to form the metal matrix.

Unless specified to the contrary, the melting temperatures $T_1$, $T_2$, and $T_3$ are expressed in ° C. (degrees Celsius). Unless specified to the contrary, a magnitude written |A| designates the absolute value of the magnitude A.

The fact that the temperatures $T_1$, $T_2$, and $T_3$ satisfy the above two inequalities makes it possible to guarantee excellent compatibility between the metal sheaths of the fibers and the first and second powders, so as to perform effective diffusion welding and obtain an interface of good quality between the fibers and the metal matrix, thus making it possible to have a part that presents the desired mechanical properties.

The fact of using first and second preforms based on powders serves advantageously to simplify fabricating the composite material part significantly, in particular because of the possibility of taking advantage of the same heat treatment step both for bonding the sheaths of the fibers to the metal matrix, and also for densifying the first and second preforms to form the metal matrix. It is possible to obtain parts presenting satisfactory mechanical properties by such a simplified method because the materials used possess particular melting temperatures so as to guarantee effective diffusion welding, as mentioned above.

The first binder and the second binder may be identical or they may be different. The metal powder of the first alloy may be present in the first preform at a volume content lying in the range 50% to 80%, and the first binder may be present in the first preform at a volume content lying in the range 20% to 50%. Likewise, the metal powder of the second alloy may be present in the second preform at a volume content lying in the range 50% to 80%, and the second binder may be present in the second preform at a volume content lying in the range 20% to 50%.

Preferably, both of the following conditions are satisfied:

$$|T_3-T_1|/T_1 \leq 15\% \text{ and}$$

$$|T_3-T_2|/T_2 \leq 15\%.$$

The fact of satisfying these two inequalities makes it possible advantageously to further improve the quality of the diffusion welding performed for bonding the metal sheaths of the fibers with the metal matrix, and thus further improve the mechanical properties of the parts obtained.

In an implementation, the first and second preforms may each be formed by performing a metal injection molding method.

Performing a metal injection molding method to form the first and second preforms serves advantageously to still further simplify the method, in so far as this makes it possible to obtain the first and second preforms directly with the desired dimensions or practically with the desired dimensions, and consequently to reduce the duration of subsequent machining, or indeed to omit such machining.

By way of example, the cores of the fibers may be made of silicon carbide, of zirconia, or of alumina.

Preferably, the metal sheaths of the fibers, the first alloy, and the second alloy may each be constituted in the majority by weight by a same metal element. In other words, it should be understood under such circumstances that the metal sheaths of the fibers are constituted by at least 50% by weight of a chemical element X, and that each of the first and second alloys is constituted by at least 50% by weight of the same element X.

Such an implementation serves advantageously to further improve compatibility between the metal sheaths of the fibers and the metal matrix of the resulting part.

In particular, the material forming the metal sheaths of the fibers may be identical to the first alloy and/or the second alloy.

In an implementation, the fibers may be received, in the stack structure, in grooves formed in the surface of the first preform and/or in the surface of the second preform.

Such an implementation serves advantageously to enable fibers that are relatively thick to be used for the fiber reinforcement of the part, with the grooves compensating for the thickness of the fibers, in full or in part.

In an implementation, the metal sheaths of all or some of the fibers may be in the form of continuous layers of a metal material.

In an implementation, the metal sheaths of all or some of the fibers may be in the form of respective pluralities of metal strands surrounding the cores, e.g. wound helically around the cores.

In an implementation, the fibers may comprise a first set of fibers extending along a first direction and a second set of fibers extending along a second direction that is not parallel to the first direction.

Advantageously, both of the following conditions may be satisfied: $|T_2-T_1|/T_1 \leq 25\%$, and preferably $|T_2-T_1|/T_1 \leq 15\%$. Such an implementation serves advantageously to further improve the quality of the metal matrix that is obtained.

In particular, the first alloy may be identical to the second alloy. In a variant, the first alloy may be different from the second alloy.

In an implementation, the first alloy and the second alloy may be selected from: titanium-based alloys, nickel-based alloys, cobalt-based alloys, aluminum-based alloys, and steels.

BRIEF DESCRIPTION OF THE DRAWINGS

Other characteristics and advantages of the invention appear from the following description of particular implementations of the invention, given as non-limiting examples with reference to the accompanying drawings, in which:

FIGS. 6A to 6K show various steps of a variant method of the invention; and FIG. 7 shows a detail of a variant implementation of the invention.

DETAILED DESCRIPTION OF IMPLEMENTATIONS

Figure 1A:
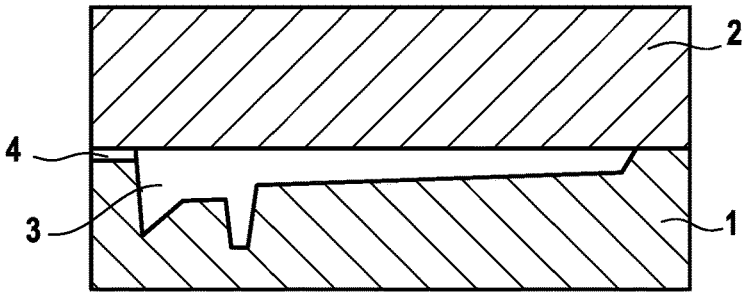
FIGS. 1A to 1G show various steps in an example method of the invention.
Figure 1B:
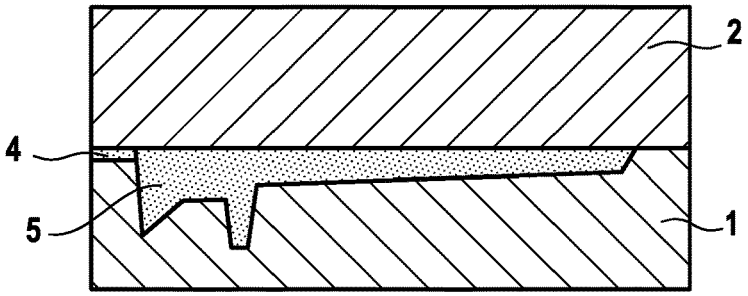

FIGS. 1A to 1G show the implementation of various steps of a first example method of the invention. FIG. 1A shows a mold cavity 3 defined between a mold 1 and a countermold 2 and in which molding is performed by injecting metal in order to obtain the first or second preform. The metal injection molding method is a technique that is itself known. The mold cavity 3 has the shape of the preform that is to be fabricated. An injection composition 5 is initially injected under pressure into the mold cavity 3. The injection composition 5 comprises a powder of a metal alloy and a binder that is to form one of the first and second preforms. By way of example, the metal alloy used in the injection composition 5 may be an alloy based on titanium, an alloy based on nickel, an alloy based on cobalt, an alloy based on aluminum, or a steel. Unless specified to the contrary, a material that is said to be "based on chemical element X" has element X at a content by weight that is greater than or equal to 50%.

The binder may be selected from: paraffins, thermoplastic resins, agar gel, cellulose, polyethylene, polyethylene glycol, polypropylene, stearic acid, polyoxymethylene, and mixtures thereof. By way of example, the volume content of the metal alloy powder in the injection composition 5 may lie in the range 50% to 80%. By way of example, the volume content of the binder in the injection composition 5 may lie in the range 20% to 50%. By way of example, the injection composition 5 may initially be mixed at a temperature lying in the range 150° C. to 200° C. under a neutral atmosphere, and may then be injected into the mold cavity 3 at such a temperature.

In the example shown, the injection composition 5 is injected into the mold cavity 3 through a single injection point 4. Naturally, it would not go beyond the ambit of the present invention for the injection composition to be injected into the mold cavity through a plurality of injection points enabling the injection composition to be injected simultaneously or otherwise into a plurality of portions of the mold cavity. During injection, the mold 1 and the countermold 2 may be temperature-regulated. By way of example, the mold 1 and the countermold 2 may be maintained at a temperature lying in the range 30° C. to 70° C. in order to encourage cooling of the blank. The blank as made in this way is said to be in a "green" or plastic state. It is advantageous to inject the injection composition 5 into a mold cavity 3 that has been evacuated, so as to facilitate injection and ensure uniformity of the blank that is to be formed.

In the example shown with reference to FIGS. 1A to 1G, each of the first and second preforms is obtained during two separate injections. By way of example, these two injections may be performed one after the other into the same mold cavity, or in a variant they may be performed in two different mold cavities, simultaneously or otherwise.

Figure 1C:
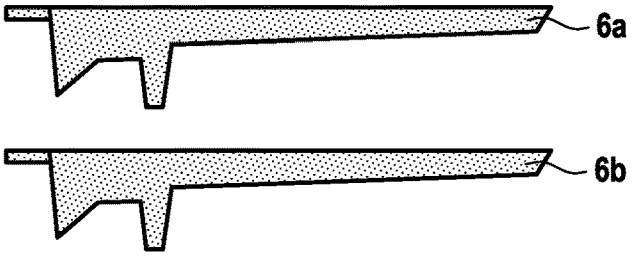
Figure 1D:
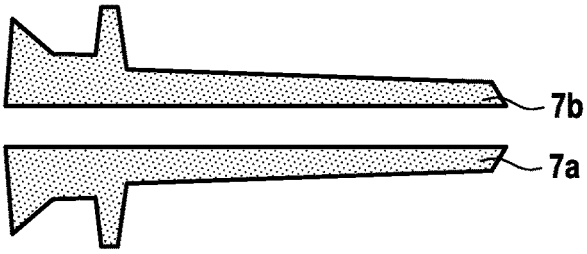

Once injection has been performed, the blanks 6*a* and 6*b* of the first and second preforms are unmolded as shown in FIG. 1C. Once they have been extracted from the mold cavity 3, the blanks 6*a* and 6*b* can be machined while in the green state in order to eliminate flash or sprue or injection points. In addition, the machining may be performed in order to modify the surfaces of the blanks 6*a* and 6*b* that are to face each other subsequently in the method and/or in order to provide grooves in the surface(s) of the first and/or second preform, as described in detail below. After performing this machining operation, there are obtained both a first preform 7*a* for a first portion of the part that is to be fabricated, this first preform 7*a* comprising at least a metal powder of a first alloy together with a first binder, and also a second preform 7*b* for a second portion of the part that is to be fabricated and comprising at least a metal powder of a second alloy together with a second binder. By way of example, the powder of the first alloy and/or the powder of the second alloy may present a D90 grain size that is less than or equal to 150 micrometers (μm) (i.e. such that at least 90% of the grains of the powder present a size that is less than or equal to 150 μm).

The present invention is not limited to performing a metal injection molding method in order to obtain the first and second preforms. Specifically, in a variant it is possible to use a tape casting method or a powder compacting method. Nevertheless, using a metal injection molding method to form the first and second preforms is advantageous in order to be able to obtain quickly blanks for said preforms that have dimensions that are close to the desired design dimensions, thereby simplifying the step of machining the blanks. Performing a metal injection molding method advantageously also makes it possible to obtain quickly preforms that are relatively complex in shape. By way of example, the part that is to be formed in the context of the method of the invention may be a turbine engine part, e.g. a turbine engine blade. In a variant, said part may present an axisymmetrical shape, and for example it may constitute an optionally segmented turbine ring.

Figure 1E:
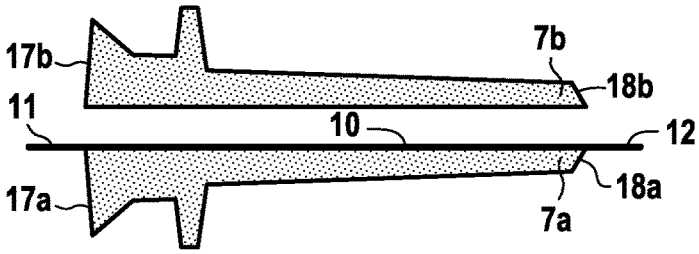
Figure 2A:
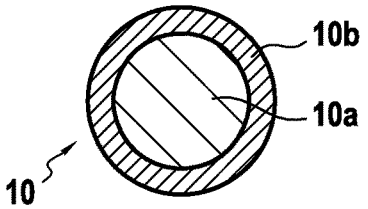
FIGS. 2A and 2B show the fiber structure used in the example method shown in FIGS. 1A to 1G.
Figure 2B:
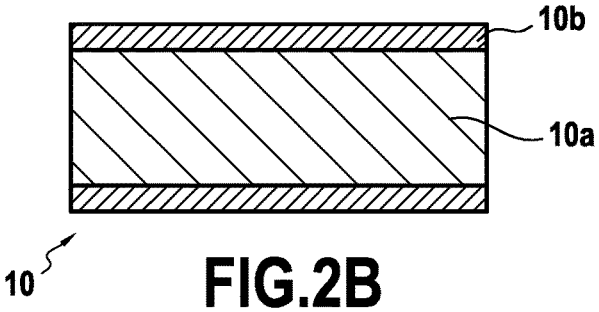
Figure 3A:
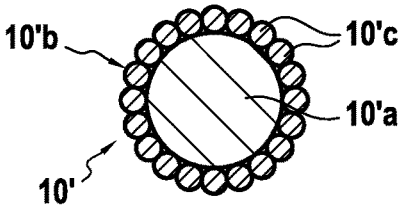
FIGS. 3A and 3B show a variant fiber structure that can be used in the context of a method of the invention.
Figure 3B:
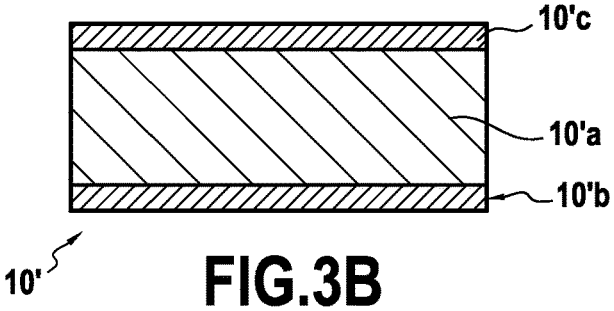

Thereafter, a step a) is performed during which a plurality of fibers 10 are positioned on the surface of the first preform 7*a*, as shown in FIG. 1E. The positioning of the fibers 10 on the first preform 7*a* may optionally be automated. FIGS. 2A and 2B show the fiber structure 10 used. FIG. 2A is a cross-section view of the fiber 10 and FIG. 2B is a longitudinal section view of the fiber 10. Each fiber 10 comprises a ceramic material core 10*a* coated in a metal sheath 10*b*. The metal material forming the sheath 10*b* may be a metal or a metal alloy. In the example shown, the metal sheath 10*b* is in the form of a continuous layer of a metal material, e.g. obtained by a high-speed coating method (HSC). By way of example, the ceramic material core 10*a* may be made of alumina, of zirconia, or of silicon carbide. By way of example, the core 10*a* may present a diameter (greatest transverse dimension) that is greater than or equal to 1 μm, e.g. lying in the range 1 μm to 140 μm. The thickness of the metal sheath 10*b* may be greater than or equal to 1 μm, e.g. it may lie in the range 1 μm to 140 μm. As described in greater detail below, the metal sheaths are to form the interfaces between the cores 10*a* of the fibers 10 and the metal matrix of the resulting composite material part. FIGS. 3A and 3B show a variant fiber 10' that is usable in the context of the method of the invention. In this variant, the metal sheath 10'*b* is in the form of a plurality of metal strands 10'*c* surrounding the core 10'*a*. Each of the metal strands 10'*c* may be wound around the core 10'*a*. The diameter of the core 10'*a* and the thickness of the metal sheath 10'*b* may be as described above with reference to FIGS. 2A and 2B. In the configuration shown in FIGS. 3A and 3B, at least six metal strands 10'*c* may surround the core 10'*a* of each fiber 10'.

As shown, and once they have been positioned on the first preform 7*a*, the fibers 10 may extend over the majority (more than 50%) of the length of the first preform 7*a*, and by way of example, and as shown, they may extend over the entire length of the first preform 7*a*. Once they have been positioned on the first preform 7*a*, the fibers 10 may extend from a first end 17*a* of the first preform 7*a* to a second end 18*a* of the first preform 7*a* situated opposite from the first preform 17*a*. Once they have been positioned on the first preform 7*a*, the fibers 10 may present extra length zones 11 and 12 extending beyond the first preform 7*a*. In the example shown in FIG. 1E, the extra length zones 11 and 12 extend from opposite ends 17*a* and 18*a* of the first preform 7*a*. In general manner, the fibers 10 are positioned during step a) along the axes of the mechanical stresses that are to be applied to the part that is to be obtained. The density of fibers 10 positioned on the first preform 7*a* may be greater than or equal to five fibers per centimeter of width of the first preform 7*a*. This density of fibers 10 may be less than or equal to ten fibers per centimeter of width of the first preform 7*a*, and by way of example it may lie in the range five fibers to ten fibers per centimeter of width of the first preform 7*a*.

Figure 4A:
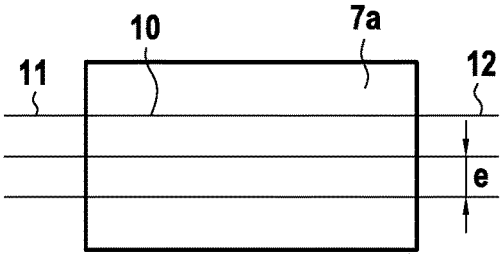
FIG. 4A shows one possible example for positioning fibers on the first preform.

FIG. 4A shows one possible example for positioning the fibers 10 on the first preform 7*a*. FIG. 4A corresponds to a plan view of the fibers 10 and of the first preform 7*a*. As shown in FIG. 4A, once they have been positioned on the first preform 7*a*, the fibers 10 may be spaced apart from one another. By way of example, the spacing e between the fibers 10 may be constant as shown in FIG. 4A. In the example of FIG. 4A, the fibers 10 are parallel to one another once they have been positioned on the first preform 7*a*. As shown in FIG. 4A, once they have been positioned onto the preform 7*a*, the fibers 10 may extend in substantially rectilinear (straight line) manner. In a variant that is not shown, the spacing between the fibers positioned on the first preform may vary. In a variant that is not shown, once they have been positioned on the first preform, the fibers may be in contact with one another.

Figure 4B:
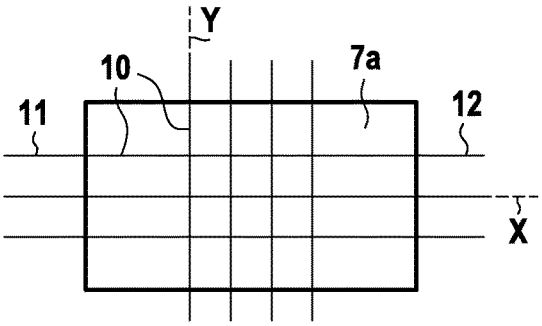
FIG. 4B shows another possible example for positioning fibers on the first preform.
Figure 5A:
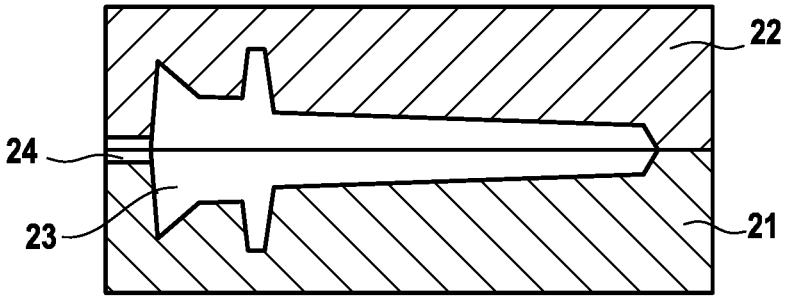
FIGS. 5A to 5D show various steps in a variant method of the invention.
Figure 5B:
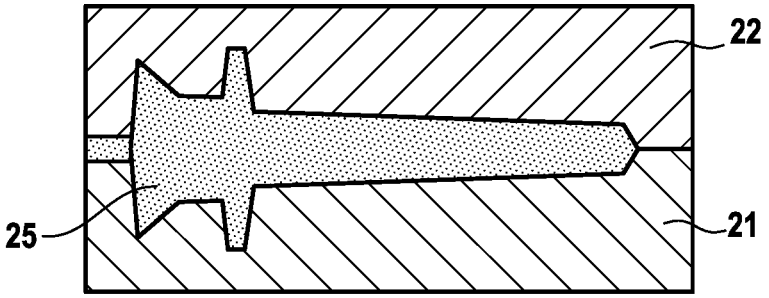
Figure 5C:
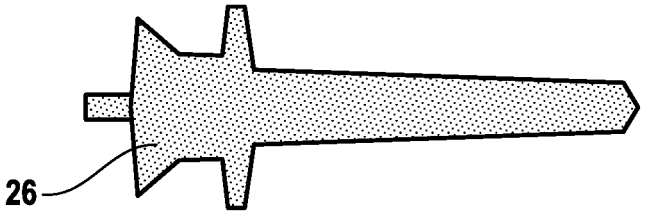
Figure 5D:
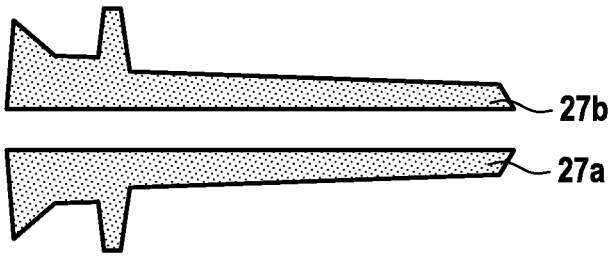

FIG. 4B shows a possible variant for positioning the fibers 10 on the first preform 7*a*. In this variant, the fibers 10 comprise a first set of fibers 10 extending along a first direction X, and a second set of fibers 10 extending along a second direction Y that is not parallel to the first direction X. By way of example, and as shown in FIG. 4B, the first direction X may be perpendicular to the second direction Y. FIGS. 4A and 4B show possible examples for positioning the fibers 10 on the first preform 7*a*, it being possible to envisage any arrangement of fibers on the first preform in the context of the invention.

Figure 1F:
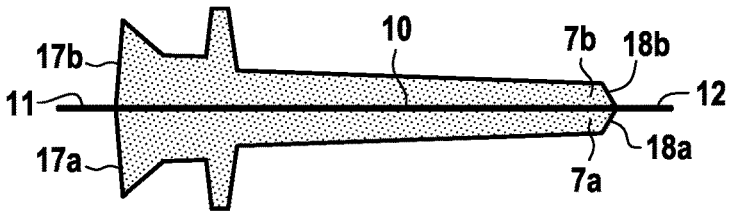

Once the fibers 10 are positioned on the first preform 7*a*, the method continues with a step b) during which the second preform 7*b* is moved up to the first preform 7*a* covered by the fibers 10 and is positioned on the first preform 7*a*, as shown in FIG. 1F. Once step b) has been performed, the fibers 10 are interposed between the first preform 7*a* and the second preform 7*b*. The fibers 10 are in contact with the first and second preforms 7*a* and 7*b*. The second preform 7*b* covers the first preform 7*a* and the fibers 10. The positioning of the fibers performed during step a) is not changed while positioning the second preform 7*b*. The details described above concerning the positioning of the fibers 10 thus remains true after performing step b). Prior to positioning the fibers 10, the first and second preforms 7*a* and 7*b* do not have any reinforcing fiber element. Specifically, the fibers 10 are to constitute the fiber reinforcement of the composite part that is to be obtained and they are present at the interface between the first and second preforms 7*a* and 7*b*.

Once step b) has been performed, the fibers 10 may extend over the majority (more than 50%) of the length of the zone of overlap between the first preform 7*a* and the second preform 7*b*, and by way of example, as shown, they may extend over the entire length of this zone. The overlap zone between the first and second preforms 7*a* and 7*b* corresponds to the zone where the first and second preforms 7*a* and 7*b* are superposed. Once step b) has been performed, the fibers 10 may extend from a first end 17*b* of the second preform 7*b* to a second end 18*b* of the second preform 7*b* situated opposite from the first end 17*b*. The extra length zones 11 and 12 of the fibers 10 may extend beyond the overlap zone between the first and second preforms 7*a* and 7*b*, as shown.

As mentioned above, the first alloy, the second alloy, and the material constituting the sheaths of the fibers are not selected in arbitrary manner. Specifically, the melting temperature $T_1$ of the first alloy, the melting temperature $T_2$ of the second alloy, and the melting temperature $T_3$ of the metal sheath of the fibers satisfy the following two conditions:

$$|T_3-T_1|/T_1 \leq 25\%, \text{ and}$$

$$|T_3-T_2|/T_2 \leq 25\%.$$

Satisfying these two inequalities relating to the relative difference between $T_3$ and $T_1$ and also to the relative difference between $T_3$ and $T_2$ serves advantageously to ensure good diffusion welding of the metal sheaths of the fibers with the metal matrix formed from the powders of the first and second alloys, and consequently to optimize the mechanical properties of the resulting part.

Advantageously, it is possible to use the following combinations:

first and second alloys based on nickel, and the metal sheaths of the fibers based on nickel;

first and second alloys based on iron, and the metal sheaths of the fibers based on iron;

first and second alloys based on titanium, and the metal sheaths of the fibers based on titanium;

first and second alloys based on cobalt, and the metal sheaths of the fibers based on cobalt;

first and second alloys based on iron, and the metal sheaths of the fibers based on nickel;

first and second alloys based on nickel and the metal sheaths of the fibers based on iron;

first and second alloys based on cobalt, and the metal sheaths of the fibers based on nickel; and first and second alloys based on nickel, and the metal sheaths of the fibers based on cobalt.

Preferably, the first and second alloys and the metal sheaths of the fibers may each be based on the same metal element. In particular, the first and second alloys may be identical and the material constituting the metal sheaths of the fibers may be identical to the material constituting the first and second alloys.

There follow a few examples of possible combinations that can be used in the context of the invention:

metal sheaths of the fibers made of TiAl 48-2-2, with first and second alloys made of TiAl 48-2-2;

metal sheaths of the fibers made of Ta6V, with first and second alloys made of TiAl 48-2-2;

metal sheaths of the fibers made of T40 titanium, with first and second alloys made of TiAl 48-2-2;

metal sheaths of the fibers made of Inconel® 718, with first and second alloys made of Inconel® 718;

metal sheaths of the fibers made of Inconel® 625, with first and second alloys made of Inconel® 718;

metal sheaths of the fibers made of nickel, with first and second alloys made of Inconel® 718;

metal sheaths of the fibers made of nickel, with first and second alloys made of 304L stainless steel;

metal sheaths of the fibers made of 304L stainless steel, with first and second alloys made of 304L stainless steel; and metal sheaths of the fibers made of 316L stainless steel, with first and second alloys made of 304L stainless steel.

Once the second preform is in position on the first preform, step b) may optionally include performing a heating step serving to assemble together the first preform, the second preform, and the fibers by means of the first and second binders. This assembly step makes it possible to obtain a consolidated stack structure comprising the first and second preforms together with the fibers interposed between said preforms. After performing this heating step, a step may be performed of machining the consolidated stack structure in order to adjust its dimensions to the dimensions desired for the final part.

The stack structure that is obtained after performing step b) is then de-bindered (step c)). During de-binding, the first and second binders present in the stack structure are selectively eliminated. During step c), it is possible to perform chemical de-binding of the stack structure during which the stack structure is put into contact with one or more solvents suitable for dissolving all or part of the first and second binders. In a variant, or in combination, it is possible during step c) to perform thermal de-binding. Under such circumstances, the thermal de-binding may be performed in a sintering enclosure in order to avoid any need to move the stack structure between step c) and step d). Thermal de-binding may be performed after using chemical de-binding. The conditions for performing de-binding that are used in the context of the present invention are themselves known.

Figure 1G:
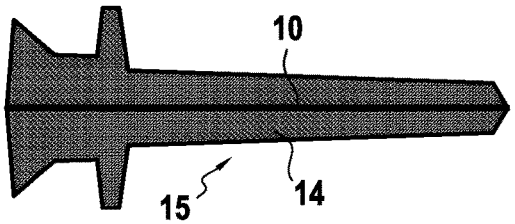

Thereafter, a step d) is performed of applying heat treatment to the de-bindered stack structure in order to obtain the part 15 made of metal composite material 14 (see FIG. 1G). During step d), the metal sheaths of the fibers become assembled with the powders of the first and second alloys by diffusion welding, and the powders are sintered so as to form the metal matrix. By way of example, during step d), it is possible to impose on the de-bindered stack structure a treatment temperature that is higher than or equal to 1200° C., e.g. lying in the range 1250° C. to 1350° C. By way of example, the duration for which the treatment temperature is imposed may be greater than or equal to 120 minutes, e.g. lying in the range 120 minutes to 180 minutes. Step d) serves to densify the powders of the first and second alloys and to create bonds between the first and second preforms and the metal sheaths of the fibers. As explained above, the fact of using fibers that are sheathed with a material that is compatible with the metal matrix serves to improve cohesion between the fibers and the metal matrix, thereby optimizing the mechanical behavior of the part that is obtained.

Furthermore, the extra length zones 11 and 12 of the fibers 10 are eliminated. This elimination of the extra length zones 11 and 12 may be performed after step d) or before step d), or indeed before step c). Once the part 15 has been obtained, an additional machining step may optionally be performed thereon in order to adjust the dimensions of the part 15 to the desired dimensions. The resulting part 15 may then be subjected to hot isostatic compacting treatment or to any finishing treatment.

In a variant of the invention that is not shown, after placing the second preform on the fibers of the first preform, it is possible, as described above, once more to position sheathed ceramic core fibers on the second preform on its side remote from the first preform and then to position a third preform comprising a metal powder of an alloy and a binder. The assembly can then be subjected to de-binding followed by heat treatment of step d) in order to obtain the composite material part. Thus, the part obtained in the context of the method of the invention may have one or more layers of fibers.

FIGS. 5A to 5D show a variant of the method of the invention in which the first and second preforms are formed during the same injection step. More precisely, the injection composition 25 is injected into the mold cavity 23 defined between the mold 21 and the countermold 22 via an injection point 24. This injection method makes it possible to form a mother blank 26 that can subsequently be subjected to a machining step. A step is then performed of cutting in two the optionally machined mother blank in order to form the first and second preforms 27*a* and 27*b* (see FIG. 5D). The method is then continued in a manner similar to that described above once the first and second preforms 27*a* and 27*b* have been obtained.

Figure 6F:
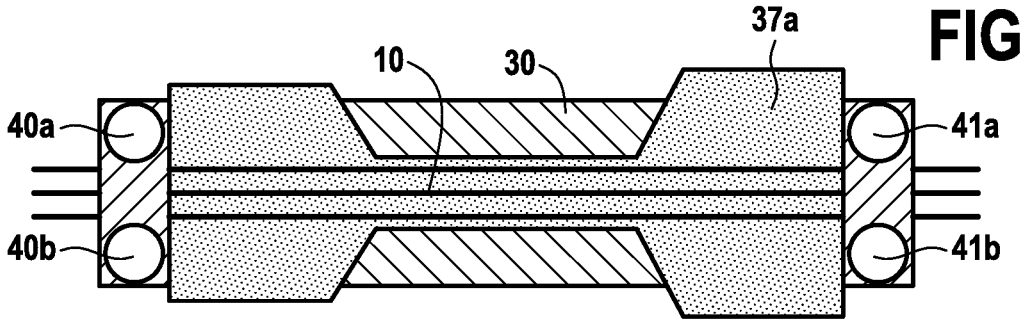
Figure 6G:
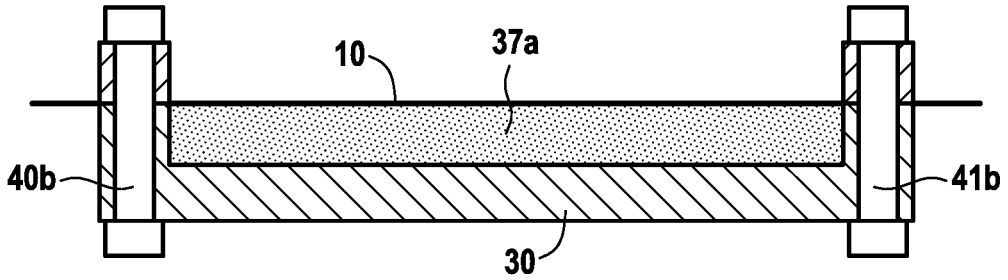
Figure 6H:
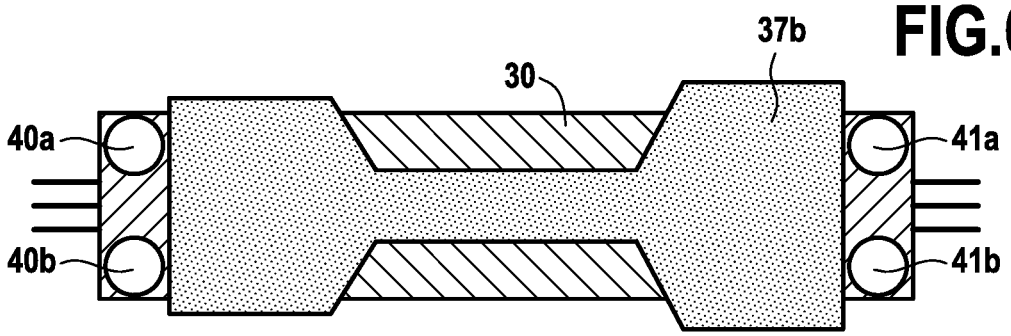
Figure 6I:
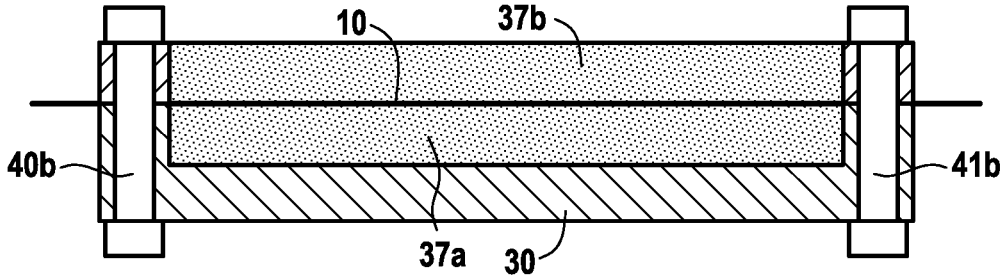

FIGS. 6A to 6K show steps of a variant implementation of a method of the invention. FIG. 6A (plan view) and FIG. 6B (longitudinal section view) show a first preform 37*a* that is present on a support 30. The first preform 37*a* is present between two side walls 31 and 32 of the support 30, and the fibers 10 are present on the first preform 37*a* and on the side walls 31 and 32. As shown, each of the side walls 31 and 32 presents openings 31*a*, 31*b*, 32*a*, and 32*b*. FIGS. 6C (plan view), 6D (longitudinal section view), and 6E (cross-section view) show the structure obtained after positioning a positioning element 35 or 36 on each of the side walls 31 and 32. As shown, each of the positioning elements 35 and 36 presents a plurality of teeth 39 between which the fibers 10 are received, thereby serving to hold the fibers 10 in the desired orientation. In addition, each of the positioning elements 35 and 36 presents openings 35*a*, 35*b*, 36*a*, and 36*b* that are positioned in register with the openings 31*a*, 31*b*, 32*a*, and 32*b* in the side walls 31 and 32 of the support 30. As shown in FIGS. 6F and 6G, the positioning elements 35 and 36 are then fastened to the support 30 by fastener elements 40*a*, 40*b*, 41*a*, and 41*b* in the form of nut-and-bolt systems in the example shown. Thereafter, the second preform 37*b* is positioned on the fibers 10 (see FIGS. 6H and 6I) and the first preform 37*a*. The preforms 37*a*, 37*b* and the fibers 10 are then assembled together by heat treatment using the binder(s) present in the preforms 37*a* and 37*b*, as explained above. The consolidated stack structure constituted by the first and second preforms 37*a* and 37*b* together with the fibers 10 is then removed from the support 30 (see FIGS. 6J and 6K) in order to be subjected to de-binding and heat treatment in step d), as explained above.

FIG. 7 shows a variant implementation in which the fibers 10 in the stack structure are housed in grooves 42*a* and 42*b* that are formed in the surface of the first preform 37*a* and/or in the surface of the second preform 37*b*. All or part of the thickness of the fibers 10 may be received in these grooves 42*a* and 42*b*. It would not go beyond the ambit of the invention for only one of the first and second preforms to present such grooves in its surface.

EXAMPLE

A mixture of a metal powder and a binder was prepared initially. The mixture comprised 60% by volume of a metal powder of TA6V alloy and 40% by volume of a mixture of polyethylene glycol, polyethylene, and polypropylene, constituting the binder. The D90 size of the TA6V metal powder used was less than 35 μm, and the powder was obtained by atomization in argon.

Starting from that mixture of TA6V powder and binder, first and second preforms were obtained. For that purpose, the mixture was injected into two injection molds. The mixture was injected at a temperature of about 190° C. and the molds were cooled to about 50° C. First and second blanks of respective portions of the parts to be obtained were obtained after injecting and molding the mixture into the molds. The two blanks were de-burred and the injection sprues were eliminated in order to obtain first and second preforms, each constituting a preform for one-half of the part to be obtained.

Fibers were then positioned on the surface of one of the two preforms. The fibers used were constituted by a central core of silicon carbide having a diameter of 80 μm, together with a sheath of pure titanium (titanium content by weight in the sheath greater than 99%) having a thickness of 10 μm. The titanium sheath was deposited on the ceramic cores by high-speed coating. The fibers were deposited in sufficient number to cover 10% of the surface area of the preform by depositing ten fibers on every 10 millimeters of the width of the preform. Tooling was used to facilitate positioning fibers and holding them in place, with the use of such tooling being optional.

Once the fibers were in position on the first preform, the second preform was positioned on the first preform and on said fibers. The assembly constituted by the stack of two preforms with fibers interposed between the two preforms and by the holder tooling was then placed in a stove maintained at 70° C. for one hour. The stoving served to bind together the two preforms by means of the binder present in the preforms and to obtain the consolidated stack structure. The consolidated stack structure was then separated from the holder tooling. The structure was then subjected to a chemical first step of de-binding by being immersed in a bath of demineralized water with the bath being stirred. The temperature of the bath was 60° C. and the de-binding step was performed for 24 hours.

Once de-binding in demineralized had been performed, the partially de-bindered structure was placed on a zirconium plate and put into an oven in order to perform heat treatment serving to finalize de-binding thermally. The heat treatment was then continued in order to sinter the metal powders so as to form the matrix of the part and so as to bond the metal sheaths of the fibers to said matrix. An argon atmosphere at a pressure of 20 millibars (mbar) was imposed during the heat treatment. The heat treatment performed presented the following characteristics:

passage from 20° C. to 200° C. with a ramp at 5° C./minute;

passage from 200° C. to 350° C. with a ramp at 2° C./minute and pause for 1 hour at 350° C.;

passage from 350° C. to 470° C. with a ramp at 2° C./minute and pause for 1 hour at 470° C.;

passage from 470° C. to 1250° C. with a ramp at 5° C./minute and pause for 3 hours at 1250° C.; and passage from 1250° C. to 80° C. with a cooling ramp at 10° C./minute.

Once the heat treatment had been performed, the resulting part was extracted from the oven and the portions of fiber projecting from the part were cut off. The part could then optionally be subjected to machining in order to adjust its shape and dimensions to the desired application.

The term "lying in the range . . . to . . . " should be understood as including the bounds.

The invention claimed is:

1. A method of fabricating a part out of composite material comprising fiber reinforcement densified by a metal matrix, the method comprising at least the following steps:

a) positioning a plurality of fibers comprising a core each made of ceramic material coated by a metal sheath on a first preform for a first portion of the part to be fabricated, said first preform comprising at least a metal powder of a first alloy and a first binder, wherein the first preform is present on a support and between two side walls of the support, the fibers being present on the first preform and on the side walls and positioning elements being positioned on each of the side walls, each of the positioning elements presenting a plurality of teeth between which the fibers are received, thereby serving to hold the fibers stationary relative to the positioning elements in a desired orientation;

b) positioning a second preform for a second portion of the part to be fabricated on the first preform in order to obtain a stack structure, the fibers being present between the first preform and the second preform in said stack structure, said second preform comprising at least a metal powder of a second alloy and a second binder, the melting temperature $T_1$ of the first alloy, the melting temperature $T_2$ of the second alloy, and the melting temperature $T_3$ of the metal sheaths of the fibers satisfying the following two conditions:

$$|T_3-T_1|/T_1 \leq 25\%, \text{ and}$$

$$|T_3-T_2|/T_2 \leq 25\%,$$

melting temperatures $T_1$, $T_2$ and $T_3$ being expressed in degrees Celsius;

c) eliminating the first and second binders present in the stack structure obtained after performing step b) in order to obtain a debindered stack structure, the stack structure being removed from the support and the fibers being removed from gaps between the teeth before eliminating the first and second binders; and d) heat treating the debindered stack structure in order to obtain the part during which the metal sheaths of the fibers are assembled with the powders of the first and second alloys by diffusion welding and during which the metal powder of the first alloy and the metal powder of the second alloy are sintered in order to form the metal matrix.

2. A method according to claim 1, wherein the following two conditions are satisfied:

$$|T_3-T_1|/T_1 \leq 15\% \text{ and}$$

$$|T_3-T_2|/T_2 \leq 15\%.$$

3. A method according to claim 1, wherein the first and second preforms are each formed by performing a metal injection molding method.

4. A method according to claim 1, wherein the metal sheaths of the fibers, the first alloy, and the second alloy are each constituted in the majority by weight by a same metal element.

5. A method according to claim 1, wherein the material forming the metal sheaths of the fibers is identical to the first alloy and/or the second alloy.

6. A method according to claim 1, wherein the fibers are received, in the stack structure, in grooves formed in the surface of the first preform and/or in the surface of the second preform.

7. A method according to claim 1, wherein the metal sheaths of all or some of the fibers are in the form of continuous layers of a metal material.

8. A method according to claim 1, wherein the metal sheaths of all or some of the fibers are in the form of respective pluralities of metal strands surrounding the cores.

9. A method according to claim 1, wherein the fibers comprise a first set of fibers extending along a first direction and a second set of fibers extending along a second direction that is not parallel to the first direction.

10. A method according to claim 1, wherein the first alloy is identical to the second alloy.

11. A method according to claim 1, wherein the first alloy and the second alloy are selected from: titanium-based alloys, nickel-based alloys, cobalt-based alloys, aluminum-based alloys, and steels.

12. A method of fabricating a part out of composite material comprising fiber reinforcement densified by a metal matrix, the method comprising at least the following steps:

a) positioning a plurality of fibers comprising a core each made of ceramic material coated by a metal sheath on a first preform for a first portion of the part to be fabricated, said first preform comprising at least a metal powder of a first alloy and a first binder; wherein the first preform is present on a support and between two side walls of the support, the fibers being present on the first preform and on the side walls and positioning elements being positioned on each of the side walls, each of the positioning elements presenting at least one opening positioned in register with an associated opening in the side walls, and each of the positioning elements presenting a plurality of teeth between which the fibers are received, thereby serving to hold the fibers stationary relative to the positioning elements in a desired orientation;

b) positioning a second preform for a second portion of the part to be fabricated on the first preform in order to obtain a stack structure, the fibers being present between the first preform and the second preform in said stack structure, said second preform comprising at least a metal powder of a second alloy and a second binder, the melting temperature $T_1$ of the first alloy, the melting temperature $T_2$ of the second alloy, and the melting temperature $T_3$ of the metal sheaths of the fibers satisfying the following two conditions:

$$|T_3-T_1|/T_1 \leq 25\%, \text{ and}$$

$$|T_3-T_2|/T_2 \leq 25\%,$$

the melting temperatures $T_1$, $T_2$ and $T_3$ being expressed in degrees Celsius;

c) eliminating the first and second binders present in the stack structure obtained after performing step b) in order to obtain a debindered stack structure; and d) heat treating the debindered stack structure in order to obtain the composite material part during which the metal sheaths of the fibers are assembled with the powders of the first and second alloys by diffusion welding and during which the powders of the first and second alloys are sintered in order to form the metal matrix.

13. A method according to claim 12, wherein the following conditions are satisfied:

$$|T_3-T_1|/T_1 \leq 15\% \text{ and}$$

$$|T_3-T_2|/T_2 \leq 15\%.$$

14. A method according to claim 12, wherein the first and second preforms are each formed by performing a metal injection molding method.

15. A method according to claim 12, wherein the metal sheaths of the fibers, the first alloy, and the second alloy are each constituted in the majority by weight by a same metal element.

16. A method according to claim 12, wherein the material forming the metal sheaths of the fibers is identical to the first alloy and/or the second alloy.

17. A method according to claim 12, wherein the fibers are received, in the stack structure, in grooves formed in the surface of the first preform and/or in the surface of the second preform.

18. A method according to claim 12, wherein the metal sheaths of all or some of the fibers are in the form of continuous layers of a metal material.

19. A method according to claim 12, wherein the fibers comprise a first set of fibers extending along a first direction and a second set of fibers extending along a second direction that is not parallel to the first direction.

20. A method according to claim 12, wherein the first alloy is identical to the second alloy.

* * * * *